US007175602B2

(12) United States Patent
Diaz et al.

(10) Patent No.: US 7,175,602 B2
(45) Date of Patent: Feb. 13, 2007

(54) PORTABLE THERAPY DEVICE

(76) Inventors: Robert Diaz, 123 Pembroke Dr., Palm Beach Gardens, FL (US) 33418; Jarrett L. Spence, 12319 N. 182nd Rd., Jupiter, FL (US) 33478; Jerry Sileo, 2327 Windsor Rd., Palm Beach Gardens, FL (US) 33410

( * ) Notice: Subject to any disclaimer, the term of this patent is extended or adjusted under 35 U.S.C. 154(b) by 0 days.

(21) Appl. No.: 11/125,851

(22) Filed: May 9, 2005

(65) Prior Publication Data

US 2005/0273022 A1 Dec. 8, 2005

Related U.S. Application Data

(60) Provisional application No. 60/570,132, filed on May 10, 2004.

(51) Int. Cl.
*A61H 1/02* (2006.01)

(52) U.S. Cl. ..... 601/5; 601/33; 601/34

(58) Field of Classification Search ..... 601/5, 601/23, 26, 27, 29, 31, 33, 34–35, 104; 602/16, 602/20, 21, 36, 37; 482/44, 45, 114, 118
See application file for complete search history.

(56) References Cited

U.S. PATENT DOCUMENTS 4,492,222 A * 1/1985 Hajianpour ..... 601/33
4,549,534 A 10/1985 Zagorski et al.
4,665,899 A * 5/1987 Farris et al. ..... 601/33
4,930,497 A * 6/1990 Saringer ..... 601/34
4,974,830 A * 12/1990 Genovese et al. ..... 601/29
5,280,783 A 1/1994 Focht et al.
5,285,773 A * 2/1994 Bonutti et al. ..... 601/34
5,399,147 A 3/1995 Kaiser
6,325,770 B1 12/2001 Beny et al.
6,743,187 B2 6/2004 Solomon et al.
2003/0120186 A1 6/2003 Branch et al.

* cited by examiner

*Primary Examiner*—Quang D. Thanh
(74) *Attorney, Agent, or Firm*—McHale & Slavin, P.A.

(57) ABSTRACT

A portable medical device suitable for use in continuous passive motion (CPM) rehabilitation programs has a lightweight modular frame for ease of storage and portability. In one embodiment a proximal sling module is pivotally connected to a distal sling module with is pivotally connected to a heal plate module. Another embodiment includes a base module is pivotally connected to a proximal sling module which is pivotally connected to a distal sling module pivotally connected to a link pivotally connected to the base. The joint of a patient's limb is flexed through a range of motion by pivoting the distal sling module relative to the proximal sling module. The device is powered by a motor and worm gear directed by a controller.

14 Claims, 9 Drawing Sheets

PORTABLE THERAPY DEVICE

CROSS REFERENCE TO RELATED APPLICATION

This application is based upon Provisional Patent Application 60/570,132, filed May 10, 2004, the contents of which are herein incorporated by reference.

FIELD OF THE INVENTION

This invention relates to continuous passive motion therapy devices for flexing joints through a selected range of motion.

DESCRIPTION OF THE PRIOR ART

Patients of knee, hip and other joint surgeries have long been shown benefit from immediate therapy and motion of the joint under treatment. Therapy may be prescribed by orthopedic surgeons following total knee replacement, anterior cruciate ligament reconstruction, tendon repair, joint manipulation under anesthesia, arthrosporic debridement of adhesions, open reduction and interior fixation (stabilization) of intra-articular fractures, articular cartilage micro fracture, and articular cartilage transplantation. However, automation of such joints can be near impossible immediately following surgery due to invasive and, often, destructive procedures. Continuous Passive Motion (hereinafter referred to as, CPM) machines were developed that allow a patient to immediately start to exercise such joints and begin the healing process. Passive range of motion is defined by articulating the joint without the patient's muscles being used. There are CPM devices for the knee, ankle, shoulder, elbow, wrist and hand.

In today's health care environment in which hospital discharge is nearly immediately after surgery, patients can benefit from a device that is also suitable for home use. Current state of the art therapeutic machines for treatment of the leg, knee, and hip illnesses or surgery are large stationary devices that are not well suited for patients in-home use. The devices are relatively heavy and require the patient to lie prone to utilize the device.

For example, U.S. Pat. No. 4,549,534 to Zagorski et al; U.S. Pat. No. 4,930,497 to Saringer; U.S. Pat. No. 5,280,783 to Focht et al.; U.S. Pat. No. 5,399,147 to Kaiser; U.S. Pat. No. 6,325,770 to Beny et al.; U.S. Pat. No. 6,743,187 to Solomon et al.; and published U. S. Patent Application, Pub. No. US 2003/0120186 A1 to Branch et al., all disclose a CPM device with a long heavy base connected to an articulated frame for manipulating the body member and a mechanical system for moving the frame along the tract.

SUMMARY OF THE INVENTION

A lightweight portable therapy device which attaches to the patient for flexing a joint through a range of motion. A patient can use this system post-operatively and upon release from the hospital, the device can be used at home to assist in patient recovery. In a particularly preferred embodiment, the device employs a modular frame construction that can be either folded or separable into at least two modules defined as a proximal sling module and a distal sling module.

In another embodiment, the device can include a base module. The base module having a link with one end of the proximal sling module pivotally connected to one end of the distal sling module to provide range of motion. The other end of the proximal sling module is pivotally connected to one end of the base module while the other end of the distal sling module is pivotally connected to one end of the link. The end of the link is pivotally connected to the base intermediate to one end of the base and the bottom. In each of the aforementioned embodiments, the modules include removable connectors cooperating with each of the pivotally connected ends whereby removal of the connectors permits disassembly of the modular frame.

Therefore, it is an objective of this invention to provide a CPM device that is lightweight, portable, user friendly, multi-functional and that is easy to use by health care providers and patients.

It is another objective of this invention to provide a CPM device that can be used by the patient in a reclining position, prone position or a sitting position.

It is yet another objective of this invention to provide a portable, lightweight, low voltage, high torque motor and controller supplied power by either battery operation or connected to an electrical grid.

It is another objective of this invention to provide a set of limit parameters in the controller, including a signaling device, to perform a safety shut-down or pause due to anomalies occurring in the programmed routine.

It is a further objective of this invention to provide a controller and control module with wireless communication capability.

It is a still further objective of this invention to provide a CPM device, with wheeled heel supports that allows the CPM to be used in a sitting position, as in riding along the floor, or with limited control by the patient while sitting in a bed.

Yet another objective of the present invention is to provide a track or rail system to isolate the movement of the wheels, such that the wheels can operate smoothly over any surface (i.e. rumpled bed sheets, thick carpet, or the like).

Still another embodiment of the instant invention provides an adjustable rigid, or semi-rigid, support means that is removably or permanently attached to the proximal sling module and distal sling modules to provide pressure to the upper portions of the patient's limb to cradle and hold the limb to achieve the maximum possible extension, similar to the manual techniques employed by physical therapists.

An additional objective of the invention is to provide a device which is light-weight and folds into a manageable package, that can be readily rolled along its own wheels.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as representative basis for teaching one skilled in the art to variously employ the present invention in virtually any appropriately detailed structure.

Figure 2:
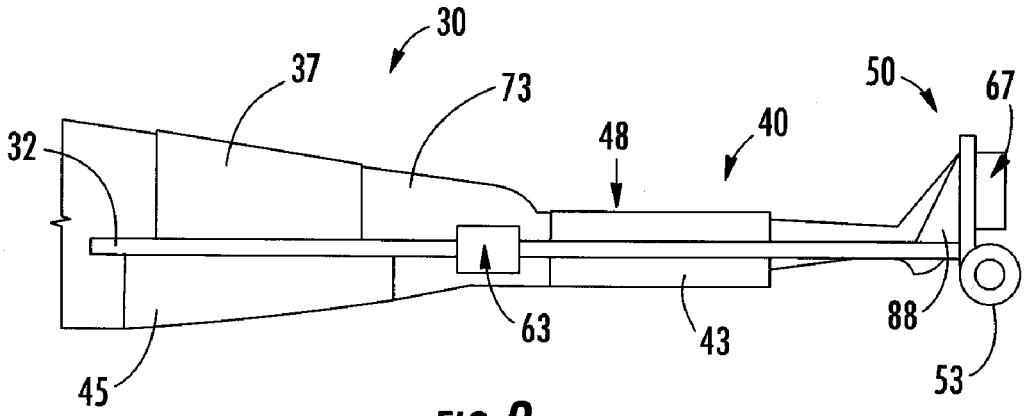
FIG. 2 is a right side view of the same basic therapy device shown in FIG. 1.
Figure 1:
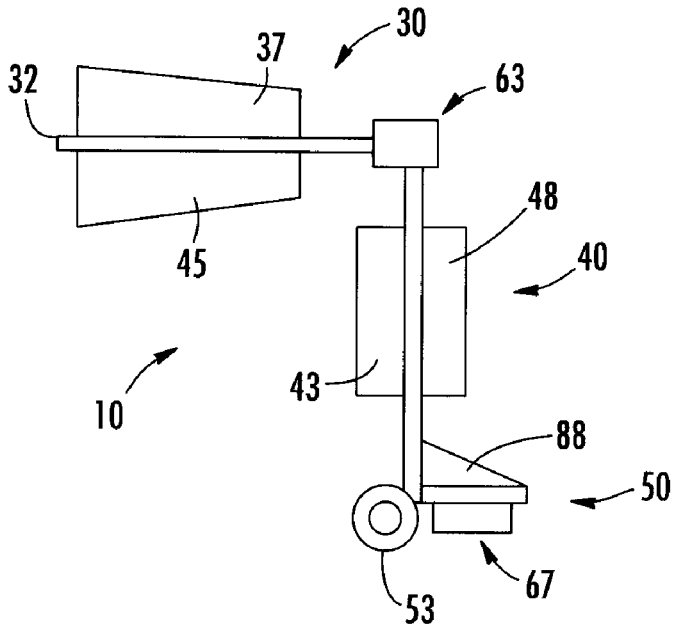
FIG. 1 is a right side view of the basic therapy device with the frame in the flex position.

Referring now FIGS. 1 and 2 which shows a version illustrating the major components of the instant modular therapy frame device, or assembly, generally referred to as 10. FIG. 1 is right side view of a basic modular therapy device in the flexed position, wherein the modular frame assembly the can be either folded up or disassembled for easy transport and storage. The device 10 includes a proximal sling module 30, a distal sling module 40, a heel plate module 50 with wheel assembly comprising left and right wheels 53, 54 and an operating system 63 with a motor 64 (FIG. 3) mounted to the distal sling module 40, the motor 64 in communication with a controller 67.

FIG. 2 is right side view of the same basic therapy device 10 shown in FIG. 1. FIG. 2 illustrates a patient's limb 73 within the device 10, in the extended position.

Preferably, the modular components 30, 40 of the frame are constructed of, albeit not limited to, a hollow rectangular box beams of lightweight materials, such as aluminum or thin gauge steel or plastic, which make it easy for the user to transport. In addition, other materials and shapes, having the requisite strength, rigidity and weight, may be utilized.

Figure 14:
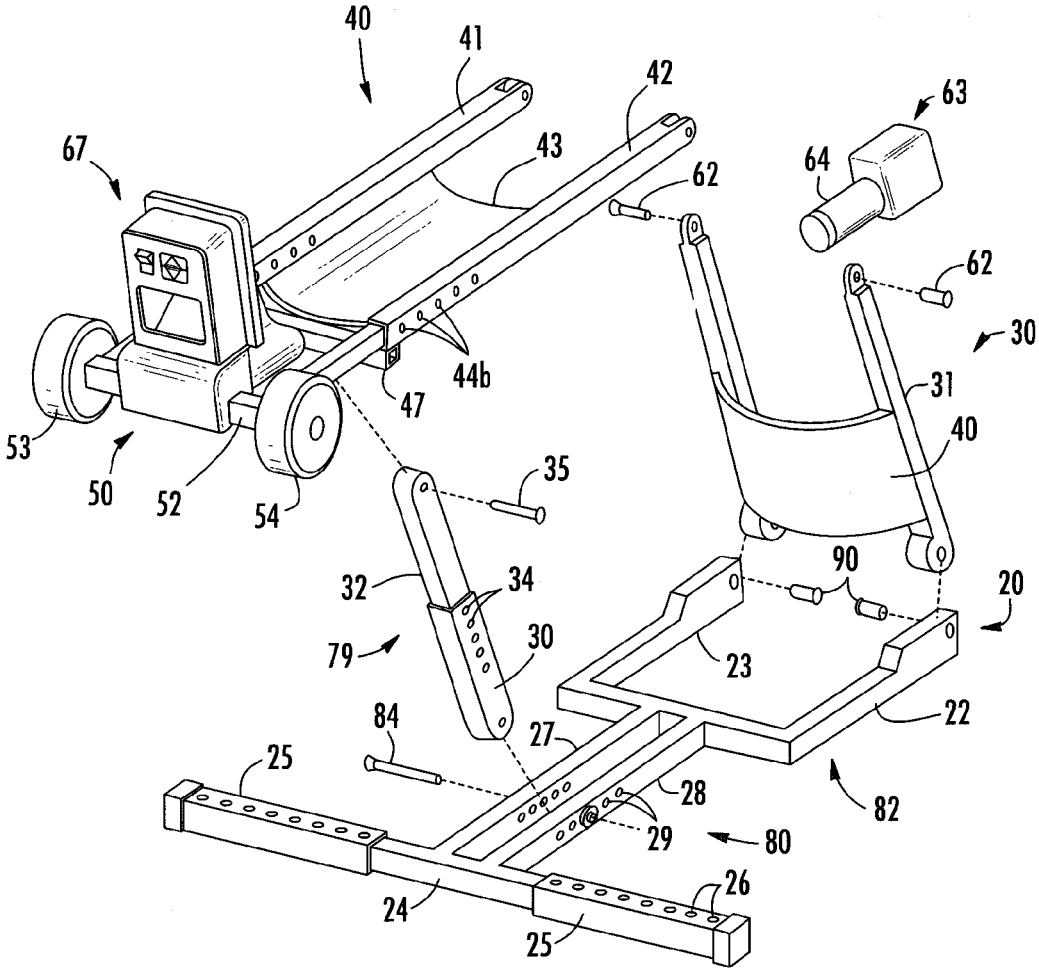
FIG. 14 is an exploded perspective of the components of the modular frame of the embodiment in FIG. 10.

One example of a means for connecting the modules 30, 40 are illustrated in the exploded view in FIG. 14, which illustrates apertures formed along at least one of the ends the frame members which are constructed and arranged to cooperate with at least one pin 62 to form pivoting connections between modules 30, 40. However, the means for connecting the may be attached by bolts and nuts, bolt and coddle pins or any other similar means of removable connection known in the art.

Figure 3:
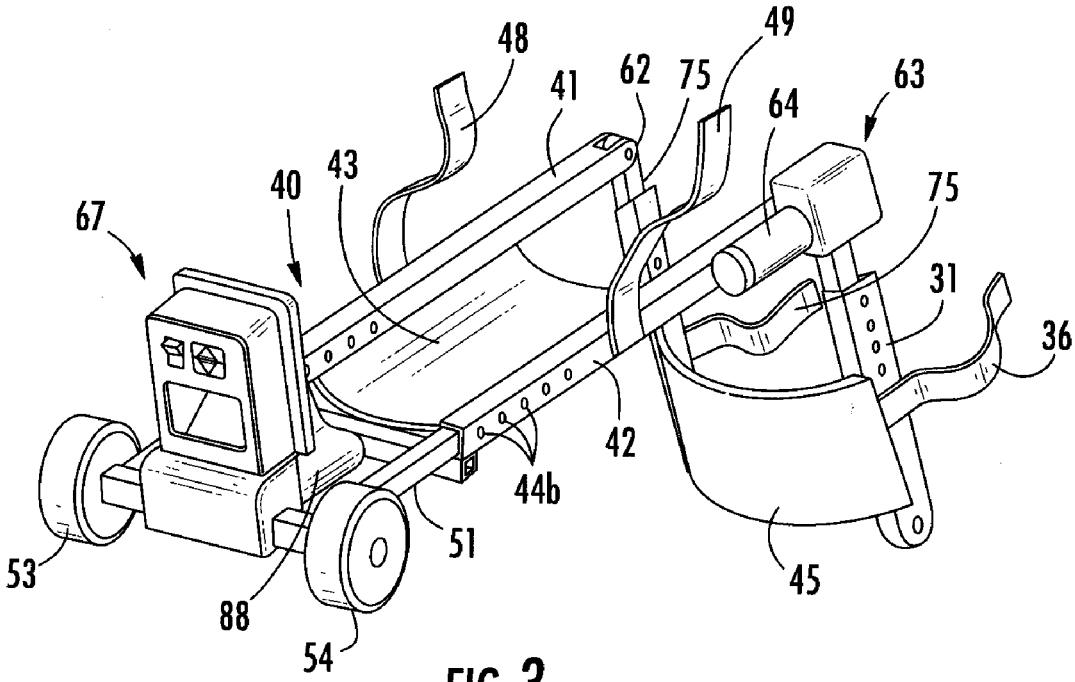
FIG. 3 is a front perspective view of the preferred embodiment of device in the flex position.
Figure 4:
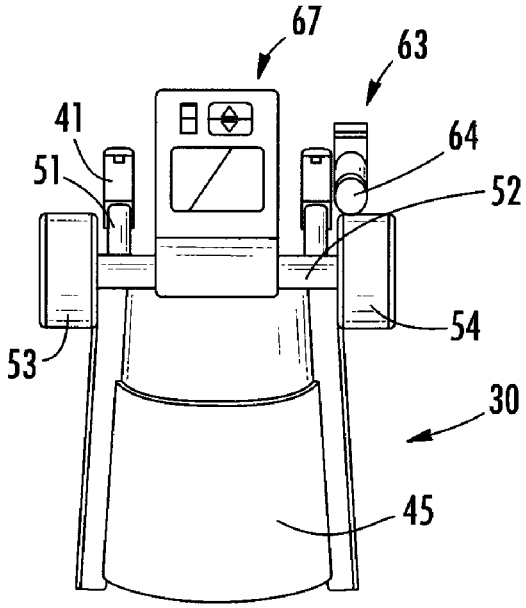
FIG. 4 is an front end view of the therapy device of FIG. 3 in a flex position.

Referring now to FIGS. 3–4, which illustrate the various components of the preferred embodiment of the present invention. The embodiment shown in FIG. 3-9, is preferred as it is lighter and less cumbersome and may be used with the patient in the sitting position. The device 10 of this embodiment weights about 14 pounds and folds into a transportable package of about 12 inches by about 14 inches.

At the distal sling module 40, a cross member 47 is attached at each end to two elongated rods 41, 42 which extend parallel along the distal portion of the patient's limb during flexing of the joint. At least one adjustable or permanent lower support means 43 extends between the two elongated rods 41, 42 to cradle the lower portion of the patient's limb as the two elongated rods 41, 42 pivot through a preselected range of motion.

Figure 5:
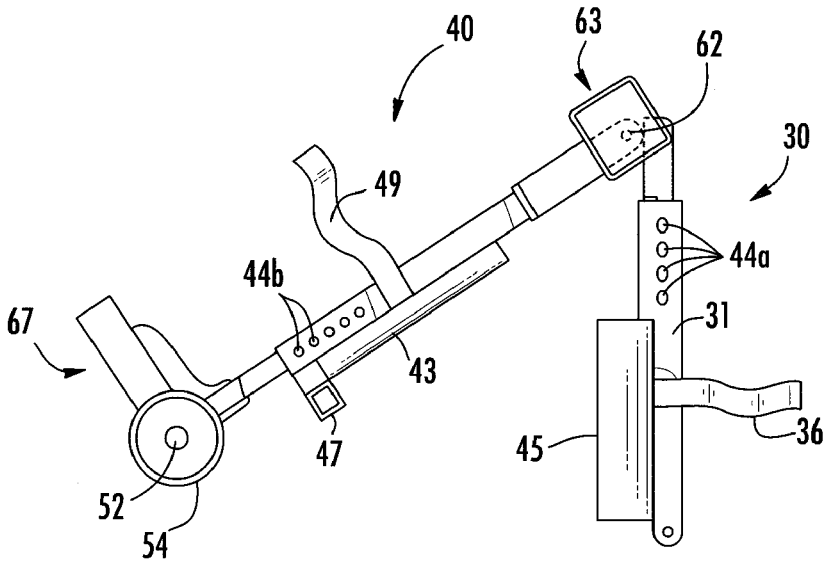
FIG. 5 is a left side view of the therapy device of FIG. 3 with the frame in the flex position.
Figure 6:
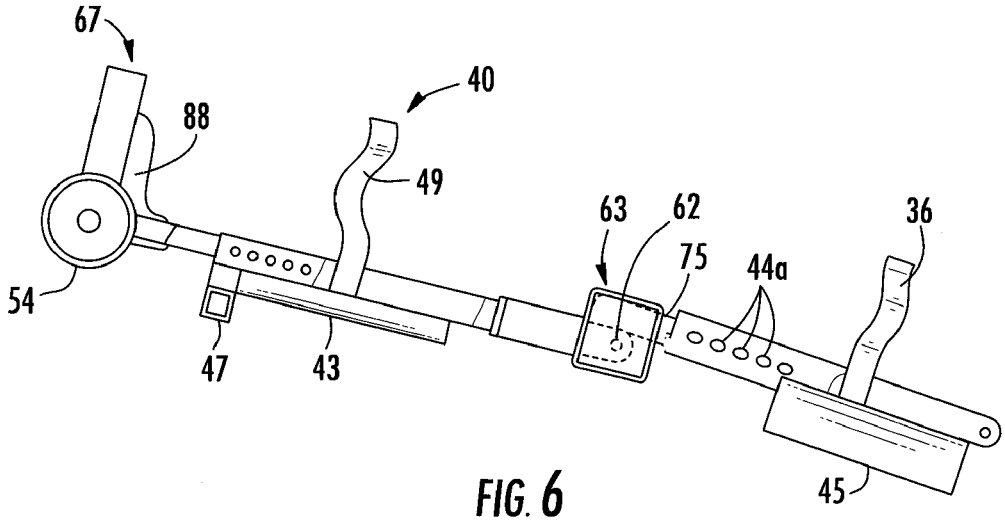
FIG. 6 is a left side view of the therapy device of FIG. 3 with the frame in the extended position.

The opposite ends of the elongated rods 41, 42 of the distal sling module 40 can be either pivotally connected to the lower end of elongated beams 31, 32 of the proximal sling module 30, using any removable connection means 62, shown here as, albeit not limited to, a removable pin (FIGS. 5, 6). Otherwise, the elongated rods 41, 42 of the distal sling module 40 are pivotally connected to distal module extensions 75, which telescope into the ends of the elongated beams 31, 32 of the proximal sling module 30.

If the elongated rods 41, 42 of the distal sling module 40 are pivotally connected to distal module extensions 75, then distal ends of the elongated beams 31, 32 of the proximal module 30 have at least one of aperture or detent 44*a* for cooperating with spring loaded buttons located on two extensions 75 connected to the distal sling module 40. The two extensions 75 telescope into the ends of the elongated beams 31, 32 of the proximal sling module 30. These cooperating fasteners permit the precise adjustment in length to virtually any limb, such as, knee to hip length.

Similarly, the distal ends of the elongated rods 41, 42 of the distal module 40 have a series of apertures or detents 44*b* for cooperating with spring loaded buttons on the heel plate module 50. The heel plate module 50 has two extensions 51 which telescope into the ends of the rods 41, 42 of the distal sling module 40. These cooperating fasteners permit the adjustment in length to fit limbs of different height, for example, the length from knee to foot.

The proximal sling module 30 and/or a distal sling module 40 can each include at least one adjustable upper support means. Although not limited to, the embodiments of FIG. 3-9, illustrate two separate support means 36, 37, 48, 49 to provide pressure to the upper portions of the patient's limb to achieve the maximum possible extension, similar to the manual techniques employed by most physical therapists.

The adjustable upper support means 36, 37, 48, 49 can be removably or permanently attached to the proximal sling module 30 and/or distal sling module 40 by any means of attachment (not shown) known in the art, i.e., adhesives, rivets, or the like.

Figure 7:
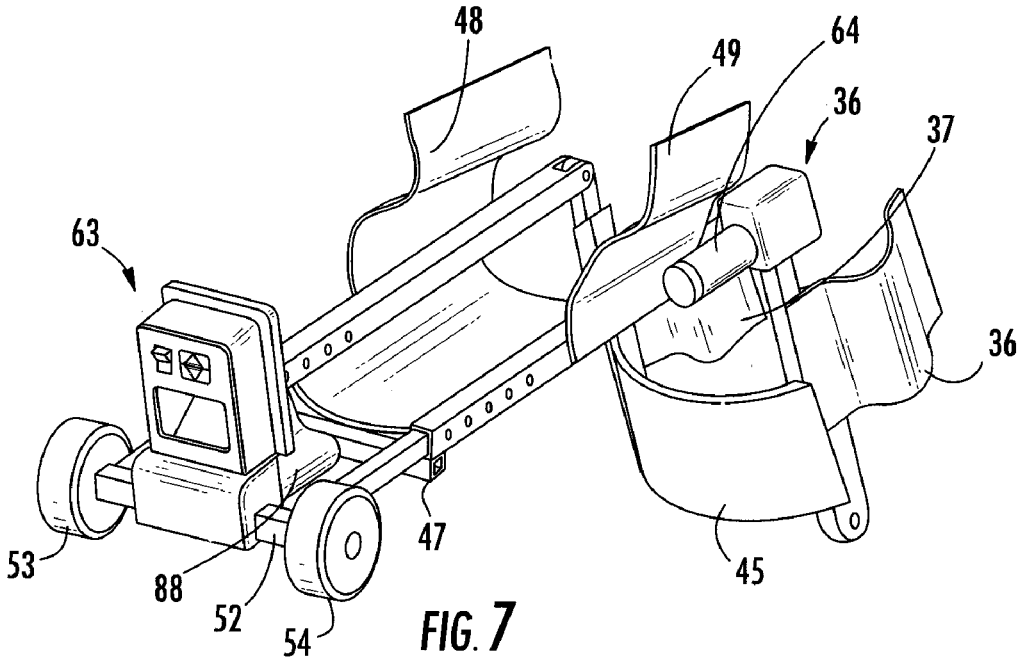
FIG. 7 is a left side perspective view of the therapy device with the frame in the flex position with longer upper support means on both the proximal and distal modules.

Moreover, the removable, adjustable upper support members 36, 37, 48, 49 can be any made into any length along the longitudinal axis of the elongated beams 31, 32 and/or elongated rods 41, 42. This is advantageous since after most post-operative situations, more pressure along the upper portion of proximal and/or distal portion of the patient's limb is desired. Thus, a longer upper support member 36, 37, 48, 49 is needed, as shown in FIG. 7. However, during the physician prescribed period of use of the instant CPM device, the longer upper support member 36, 37, 48, 49 can be removed and replaced with thinner upper support members, that will provide less pressure along the upper portion of the patient's limb.

The upper support means 36, 37, 45, 46, 48, 49 can be constructed of a rigid, semi-rigid material or a composite, for example, aluminum, thin gauge steel or plastic. In addition, other materials and shapes, having the requisite strength, rigidity and weight, may be utilized, (i.e. leather, nylon, or the like). In CPM, the patient exerts no active resistance to the movement of the patient's limb nor is there any positive muscular contractions. The lower support material 43, 45 must be constructed from a material strong enough to carry the weight of the patient's limb, for example, flexible cloth, film or relatively stiff sheet.

Additionally, the adjustable upper and/or lower support means 36, 37, 43, 45, 48, 49 can include an inner lining, or padding, which is in direct contact with the patient and will provide additional comfort and protect the patient's limb from irritation and/or chaffing during CPM movement.

FIG. 5 is left side view of the modular therapy device 10 of FIGS. 3–4 in the flexed position, wherein the modular frame assembly is in the process of being folded for easy transport and storage.

FIG. 6 is left side view of the same therapy device 10 shown in FIGS. 3–4 in the extended position.

Figure 8:
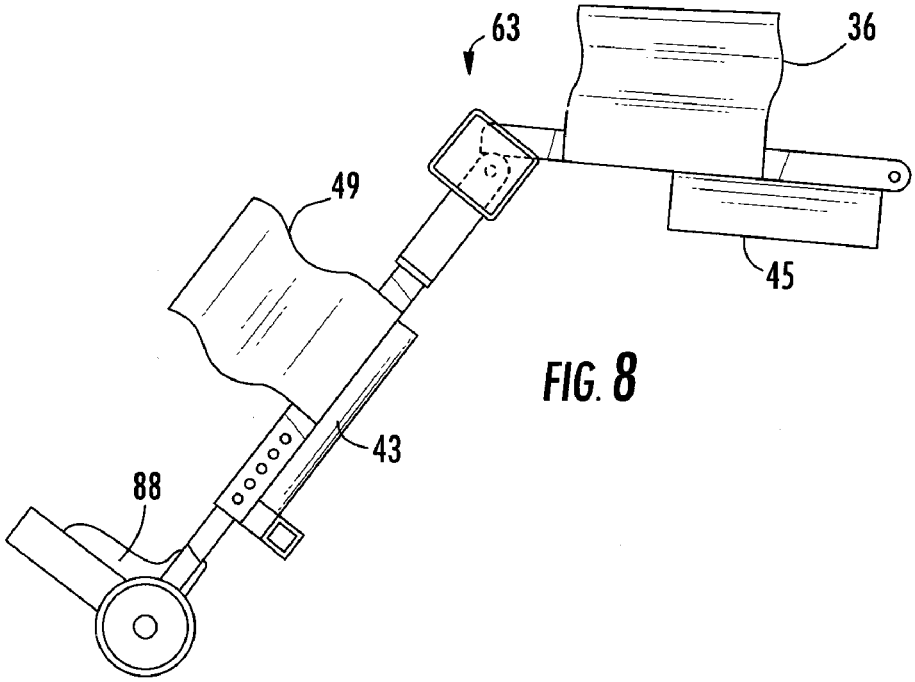
FIG. 8 is a left side view of the device of FIG. 7 illustrating the therapy device in a sitting position.

FIG. 8. is left side view of the modular therapy device 10 of FIGS. 3–4 in with the wheel assembly 53, 54 in contact with the floor surface, for a patient in a sitting position.

In the less preferred embodiment depicted in FIGS. 10–16, wherein like elements are number consistently throughout, the device 10 includes a proximal sling module 30, a distal sling module 40, a base module 20 with an adjustable link 79, a heel plate module 50 and an operating system, i.e. power assist system, comprising at least a motor 64 and controller 67.

The base module 20 serves to support the device 10 on a surface such as a floor, table, or bed. The base 20 has an elongated shape constructed and arranged for being placed horizontally on a surface. In one preferred embodiment of the base 20, the proximal portion 82 of the base 20 includes arms 22, 23 that are pivotally connected to the proximal sling module 30 via any connection means known in the art, i.e. pin 90. Like the previous embodiment, the proximal sling module 30 supports the patient's thigh or upper arm during operation of the device 10. The distal portion 24 of the base 20 can include lateral extensions 25 to increase stability.

Figure 10:
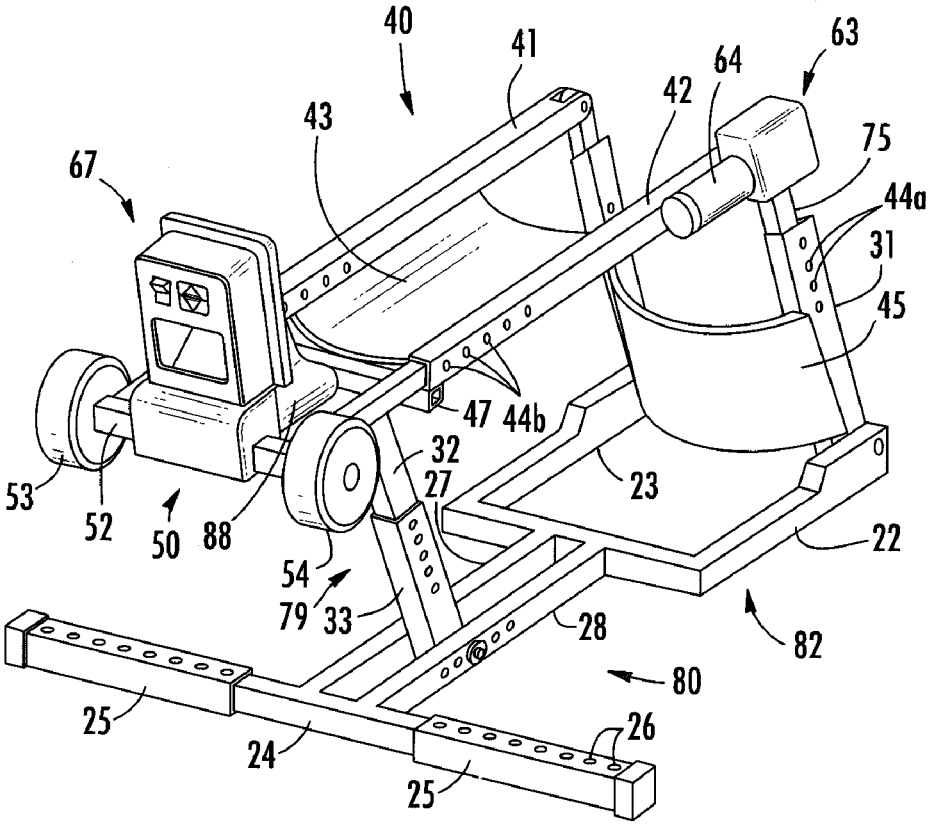
FIG. 10 is a perspective of an alternative embodiment of the therapy device pivotally attached to a base.
Figure 11:
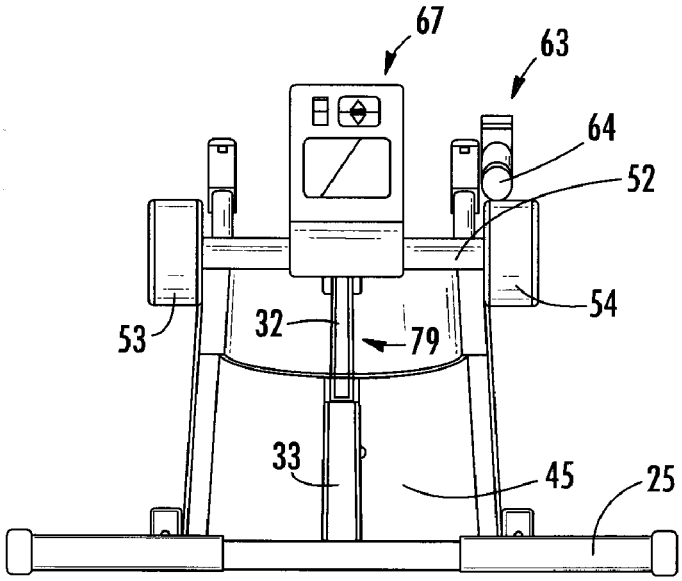
FIG. 11 is a end view of the alternative embodiment of FIG. 10.
Figure 12:
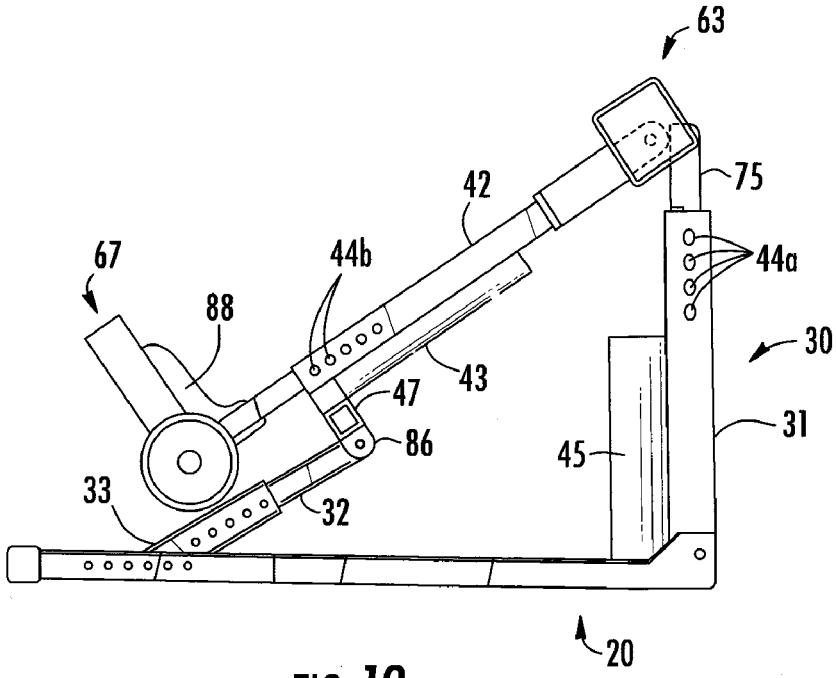
FIG. 12 is a left side view of the alternative embodiment of FIG. 10 with base in the flex position.
Figure 13:
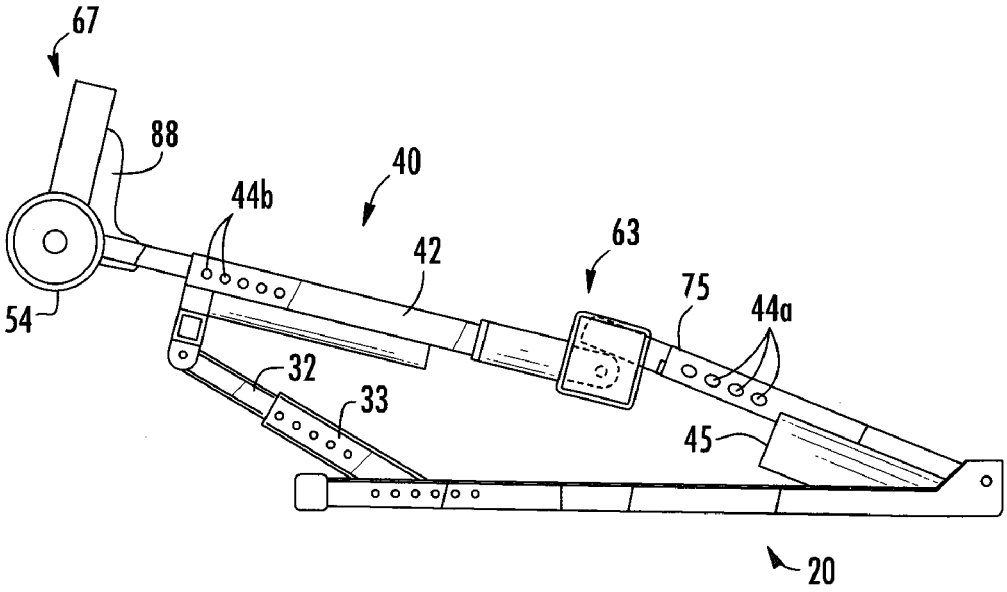
FIG. 13 is a left side view of the alternative embodiment of FIG. 10 with base in the extended position.

Though not shown in FIG. 10, the extensions 25 may be completely removed from the distal portion 24. Moreover, the extensions 25 are laterally adjustable via retainers 26 to secure the extensions in a selected position. The retainers 26 may be spring biased protrusions in the distal portion 24 cooperating with apertures 26 in the extensions or a series of apertures in both the extensions and the bottom through which pins may be inserted (not shown).

As illustrated in the exploded view of FIG. 14, the base 20 includes a shaft portion 80 which joins the proximal 82 and distal 24 ends of the base 20. In one embodiment, the shaft 80 of the base 20 is bifurcated into legs 27, 28 connecting the distal end 24 to the arms 22, 23. The legs 27, 28 of the shaft 80 have a series of apertures 29 for selective pivoting connection of the adjustable link 79.

The distal sling module 40 is connected to the base 20 by via the adjustable link 79 which is variable in length by telescoping components 32, 33 selectively positionable by retainers 34 similar to those on extensions 25. Preferably, the adjustable link 79 is centered between the legs 27, 28 and pivotably connected to the base 20 by a pin 84 extending through both legs 27, 28 and the end of the pin 84. The other end of the link 79 is pivotably connected to the distal sling module 40 by another pin 35 extending through bracket 86 connected to cross member 47, shown in FIGS. 12–13.

Similar to the previous embodiment of FIGS. 3–8, the cross member 47 of FIGS. 10–14 is attached at each end to two elongated rods 41, 42 which extend parallel along the distal portion of a patient's limb during flexing of the joint. A support material 43 extends between the two elongated rods 41, 42 to carry the limb as the elongated rods pivot through a preselected range of motion. The material 43 may be flexible cloth, film, or a relatively stiff sheet.

As illustrated in FIG. 14, the distal ends of the elongated rods 41, 42 have a series of apertures or detents 44*b* for cooperating with spring loaded buttons on the heel plate module 50. The heel plate module 50 has two extensions 51 which telescope into the ends of the rods 41, 42 of the distal sling module. These cooperating fasteners permit the adjustment in length to fit limbs of different height.

The opposite ends of the elongated rods 41, 42 of the distal sling module 40 are pivotally connected to the lower end of elongated beams 31, 32 using removable any removable connection means 62, shown here as, albeit not limited to, a removable pin (FIG. 14). Otherwise, the elongated rods 41, 42 of the distal sling module 40 are pivotally connected to distal module extensions 75, which telescope into the ends of the elongated beams 31, 32 of the proximal sling module 30.

The patient's joint to be flexed will be situated adjacent this pivotal connection means 62 with the proximal portion of the limb supported by the proximal sling module 30. Elongated beams 31, 32 extends along each side of the patient's limb with a lower support material 45 between the elongated beams 31, 32 supporting the proximal portion of the limb.

If the elongated rods 41, 42 of the distal sling module 40 are pivotally connected to distal module extensions 75, then the distal ends of the elongated beams 31, 32 have a series of apertures or detents 44*a* for cooperating with spring loaded buttons on the distal module extensions 75, as they telescope into the ends of the elongated beams 31, 32. These cooperating fasteners permit the precise adjustment in length to virtually any limb, such as, knee to hip length.

Similarly, the distal ends of the elongated rods 41, 42 have a series of apertures or detents 44*b* for cooperating with spring loaded buttons on the heel plate module 50. The heel plate module 50 has two extensions 51 which telescope into the ends of the rods 41, 42 of the distal sling module. These cooperating fasteners permit the adjustment in length to fit limbs of different height, for example, the length from knee to foot.

Although not shown in FIG. 10-14, the proximal sling module 30 and/or a distal sling module 40 can each include an adjustable upper support means 36, 37, 48, 49 to provide pressure to the upper portions of the patient's limb. The adjustable upper support means 36, 37, 48, 49 can be removably or permanently attached to the proximal sling module 30 and/or distal sling module 40 by any means of attachment (not shown) known in the art, i.e., adhesives, rivets, or the like.

Moreover, the removable, adjustable upper support members 36, 37, 48, 49 can be any constructed into any length along the longitudinal axis of the elongated beams 31, 32 and/or elongated rods 41, 42.

The upper support means 36, 37, 45, 46, 48, 49 can be constructed of a rigid, semi-rigid material or a composite, for example, aluminum, thin gauge steel or plastic. In addition, other materials and shapes, having the requisite strength, rigidity and weight, may be utilized, (i.e. leather, nylon, or the like). The lower support material 43, 45 must be constructed from a material strong enough to carry the weight of the patient's limb, for example, flexible cloth, film or relatively stiff sheet.

Additionally, the adjustable upper and/or lower support means 36, 37, 43, 45, 48, 49 can include an inner lining, or padding, that will provide comfort and protect the patient's limb from irritation or chaffing during movement.

Figure 15:
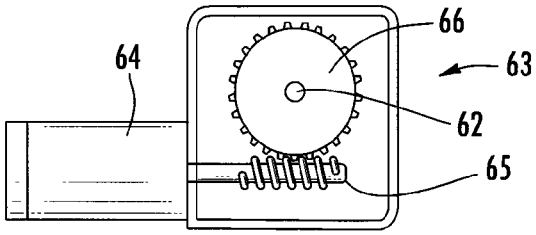
FIG. 15 is a side view of the motor and worm gear of the therapy device.
Figure 16:
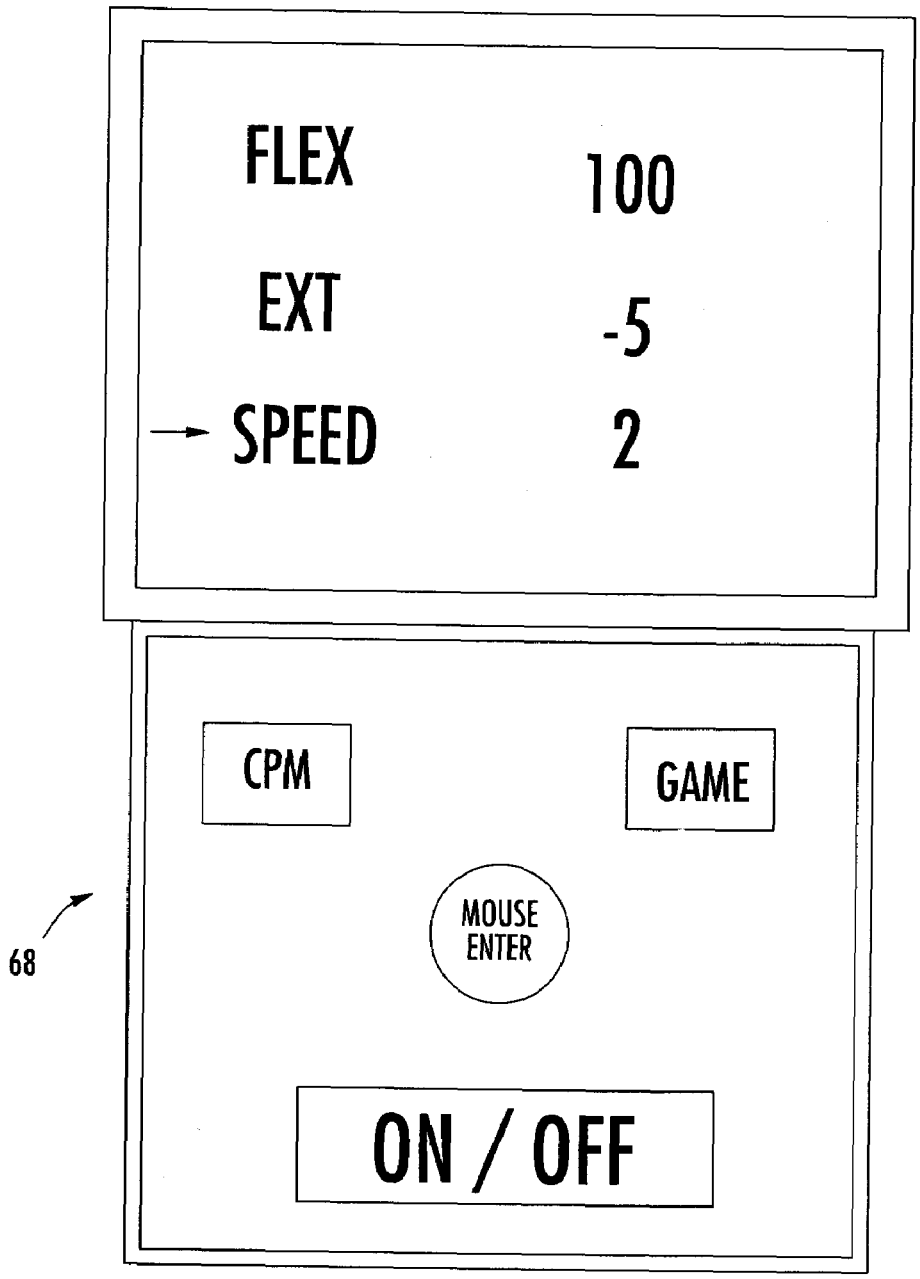
FIG. 16 is a front view of one embodiment of a wireless module for controlling the any of the aforementioned embodiments.

As illustrated in FIG. 15, the operating system, or, power assist device can include, albeit not limited to, a low powered (i.e. about 10 to about 20 VDC), hi-torque linear actuator 63, having a motor 64 mounted to the upper end of the distal sling module rod 42. The linear actuator 63 comprises a motor output shaft 65 and a complementary power transfer part, shown here as, albeit not limited to, a circular, or worm, gear 66 fixed by the pin 62 to elongated beam 31 as shown in FIG. 14. The linear actuator 63 can comprise any means for providing power, for example, stepper motor or the like.

An optical or mechanical encoder (not shown) may be used for the precise control of the linear actuator 63. The rotation of the output shaft 65 causes the circular gear 66 to turn which moves the distal sling module 40 relative to the proximal sling module 30. The motor 64 is operatively connected through either elongated rods 41, 42 with the controller 67.

The controller 67 can be as simple as an off/on switch or include a programmable system which can include a speed control means for the motor 64. Such other features which may be included into the controller 67 include, a timer for session duration, repetitions over time, and length of throw of the worm gear 66 controlling angle of flex. Also, a safety circuit may produce a signal, (i.e. audio or visual or both), if there is an extension beyond the programmed parameters.

Additionally, the controller 67 and/or linear actuator 63 may be powered by any means for supplying power known to the skilled artisan. For example, the controller 67 and/or linear actuator 63 may include a battery pack (not shown) and be connected to the motor 63 through interior portion of either elongated rods 41, 42 or preferably by a wireless remote 68, (i.e. RF, IR, etc.), shown in FIG. 16.

The wireless remote 68 is preferred to obviate the possibility of entangling the operating system with the bed clothes or any moving parts of the device 10. A wireless receptor (not shown) may be on the controller 67 or directly on the motor 64. Although not limit to, the controller 67 is mounted on the heel plate module 50 in FIGS. 1–14.

Preferable, the heel plate module 50 has a flange 88 for supporting the extremity of the patient's limb to assist in the proper location of the patient's limb in the device. The flange 88 is mounted on an axle 52 intermediate a set of wheels 53, 54, one at each end of the axle 52. The extension 51 is mounted near each wheel 53, 54 normal to the axle 52. As previously discussed above, the ends of the extensions 51 are adjustably telescoped into the ends of the elongated rods 41, 42 of the distal sling module 40. Thus, the heel plate 50 and the distal sling module 40 may be further adjusted to comfortably conform to the length of the patient's limb.

To perform CPM on a patient's knee, for example, the patient is supine and the patient's leg is placed on the device 10 so that the thigh supported by the proximal lower support mean 45 and the calf supported by the distal lower support means 43 with the knee adjacent the pivot point between the distal sling module 40 and the proximal sling module 30, as shown in FIG. 2. The proximal sling module 30 is then strapped to the patient's limb with appropriately sized proximal upper support means 36, 37. The distal sling module 40 is fastened about the calf with distal upper support means 48, 49. In this position, the wheels 53, 54 are in contact with a supporting surface, such as the floor, so that the wheels move across the surface in response to the actuation of the linear actuator 63 (FIG. 8). The articulation of this embodiment is similar to that shown in FIGS. 3, 4 of the first embodiment and FIGS. 12, 13 of the second embodiment.

Next, the controller 67 is programed, as desired, and the motor 64 is energized. As the linear actuator 63 moves the proximal sling module 40 relative to the distal sling module 30, the patient's leg can achieve a full range of motion, for example, albeit not limited to, about −30 degrees to about +155 degrees.

Figure 9:
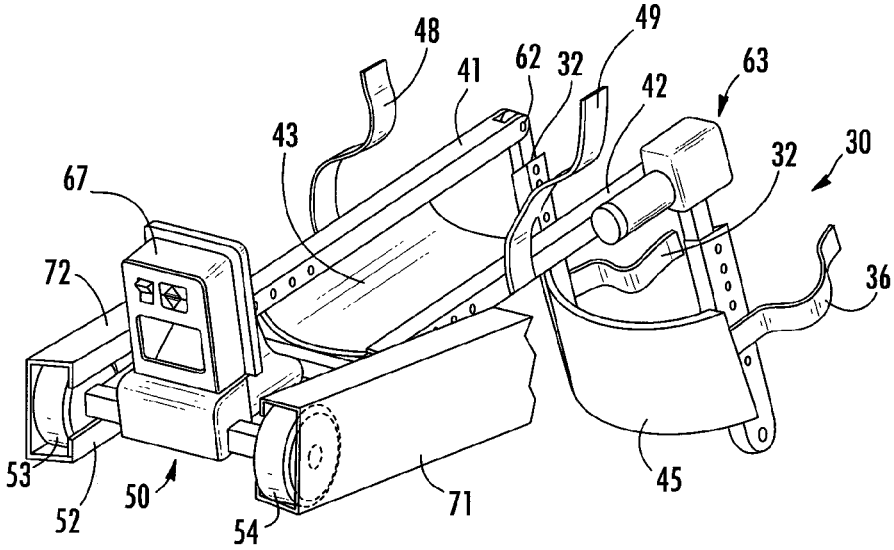
FIG. 9 is a perspective view of the therapy device with a partial track.

In addition, a track or rail system can be included on either of aforementioned embodiments of the instant device to provide unobstructed movement of the wheels 53, 54, either across the floor or across other surfaces, such as rumpled sheets on a bed, (FIG. 9). In one preferred embodiment, the track is formed as a C-shaped channel 71, 72 enclosing each wheel. The tracks 71, 72 may or may not be joined by cross ties (not shown) and the tracks 71, 72 may or may not be flexible. The length of the tracks 71, 72 is commensurate with the distance the wheels 53, 54 move in response to the operation of the linear actuator 63.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and drawings/figures.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An apparatus secured to an upper part of an individual's limb and a lower part of said individual's limb for articulating said individual's joint located therebetween through a range of motion providing continuous passive motion to said joint, said apparatus comprising:

a proximal sling module defined by first and second rigid parallel spaced apart elongated beams adapted to be secured to said upper portion of said individual's limb;

a distal sling module defined by first and second rigid parallel spaced apart elongated rods adapted to be secured to said lower portion of said individual's limb, said elongated rods pivotally connected to one end of said elongated beams, a heel plate is pivotally connected to a second end of said elongated rods, said heel plate having an axle with wheels rotatably mounted on each end of said axle; and an actuator directly attached at the pivotal connection between said proximal sling module and said distal sling module, said actuator having an electric motor juxtapositioned to either one of said elongated beams or rods, said motor including an output shaft having a longitudinal axis positioned substantially parallel to the longitudinal axis of either one of said elongated beams or rods, said actuator providing pivotal movement of said modules relative to each other.

2. The apparatus of claim 1 wherein at least a portion of said wheels are encased in a track or rail.

3. The apparatus of claim 1, wherein one end of said first and second elongated beams each have at least one aperture therethrough, a removable connection means inserted through said at least one aperture in said one end and connected to said one end of said distal sling module.

4. The apparatus of claim 3, wherein said first and second elongated beams includes a lower support means extending between said first and second elongated beams to cradle and contact at least a portion of the lower part of the patient's limb.

5. The apparatus of claim 4, wherein said first and second elongated beams includes an upper support means extending between said first and second elongated beams to cradle and contact at least a portion of the upper part of the patient's limb.

6. The apparatus of claim 4, wherein said lower support means includes an inner lining or padding for increased comfort.

7. The apparatus of claim 5, wherein said upper support means includes an inner lining or padding for increased comfort.

8. The apparatus of claim 1, wherein one end of said first and second elongated rods each having at least one aperture therethrough, a removable connection means inserted through said at least one aperture in said one end and connected to said one end of said proximal sling module.

9. The apparatus of claim 8, wherein said first and second elongated rods includes a lower support means extending between said first and second elongated rods to cradle and contact at least a portion of the lower part of the patient's limb.

10. The apparatus of claim 8, wherein said first and second elongated rods includes an upper support means extending between said first and second elongated rods to cradle and contact at least a portion of the upper part of the patient's limb.

11. The apparatus of claim 9, wherein said lower support means includes an inner lining or padding for increased comfort.

12. The apparatus of claim 10, wherein said upper support means includes an inner lining or padding for increased comfort.

13. The apparatus of claim 1, wherein a controller is mounted on said device, said controller being operatively connected to said actuator to control the operation of said actuator, said controller setting the parameters for flexing of the joint.

14. The apparatus of claim 1 further including a base module constructed and arranged for supporting said apparatus on a horizontal surface, said base module is pivotally attached to both said proximal sling module and said distal sling module such that said modules are able to pivot relative to one another when said individual is in a supine position.

* * * * *